United States Patent [19]

Bunger

[11] 3,942,328

[45] Mar. 9, 1976

[54] AUTOMATIC CANAL GATE

[76] Inventor: Mills E. Bunger, 3510 Teller St., Wheat Ridge, Colo. 80033

[22] Filed: Feb. 24, 1975

[21] Appl. No.: 552,348

[52] U.S. Cl. ..... 61/25
[51] Int. Cl.[2] ..... E02B 7/42
[58] Field of Search ..... 61/22, 23, 25, 26

[56] References Cited

UNITED STATES PATENTS

| | | | |
|---|---|---|---|
| 2,984,986 | 5/1961 | Hill | 61/25 UX |
| 3,665,715 | 5/1972 | Bunger | 61/25 |

*Primary Examiner*—Paul R. Gilliam
*Assistant Examiner*—David H. Corbin
*Attorney, Agent, or Firm*—Van Valkenburgh, Lowe & Law

[57] ABSTRACT

A pivotal canal gate, mounted in a predetermined size canal, opens and closes by a controllable weight movable in response to a float-switch mechanism for maintaining a predetermined level in the downstream side of the gate in the canal; water passing under the gate is directed into a dead-water pool breaking up the velocity of the flowing water, providing a control pool for maintaining a constant head over a discharge weir providing a predetermined quantity of water into the downstream canal.

6 Claims, 4 Drawing Figures

AUTOMATIC CANAL GATE

Water for irrigation and other purposes is normally withdrawn from a source, usually a river or other stream, through a headgate into distribution canals and ditches for the distribution of the water to points of use. Stream flow in any stream is not uniform, varying somewhat hour by hour and varying substantially season to season of the year. The variation of flow provides a considerable problem for maintaining a uniform flow in the distribution canals and ditches. Particularly in times of high water, even at flood stage, control of the water entering the canals requires exact movement of the control gates to provide for the prescribed flow in the distribution channels. Automatic gates have been provided in the art for controlling the withdrawal of water from the source, and in my U.S. Pat. No. 3,665,715, issued May 30, 1972, I have described one type of automatic gate wherein small fluctuations are countered by means of a supply of control water, weighting the gate by means of a container screwed on the downstream side of the gate. Larger fluctuations are accomplished by a movable weight, controlled by a float-switch arrangement in the downstream side. Other types of gates have been proposed in the prior art, and while each is useful to some extent, each has some operational difficulties.

According to the present invention I have provided a pivotal gate, the opening and closing of which is controlled by a movable weight responsive to a float switch mounted closely adjacent the gate, and the water discharging under the gate enters a dead-water pool breaking up the velocity of the water, thereby maintaining a predetermined head over the discharge weir from the dead-water pool. This maintains a constant flow of water in the downstream canal. The water weighting fluctuation control described in my abovementioned patent may, also, be used with the gate of the present invention if desired, providing optimum control of the gate for minor variations in flow. The gate of the invention opens and closes directly into the dead-water pool, whereby the water released under the gate is of a substantially reduced velocity maintaining a downstream control pool for actuating a float-switch mechanism controlling the position of the gate.

Included among the objects and advantages of the present invention is a pivotal canal gate for controlling the flow of water from a source to a distribution canal.

Another object of the invention is to provide a canal gate operating in a pool of dead water in a manner to reduce the velocity of water passing under the gate into the dead-water pool to provide a control pool on the downstream side of the gate.

Yet another object of the invention is to provide a pivotal canal gate opening and closing directly in a dead-water pool whereby flowing water is directed into a dead-water pool upstream of the gate and into the dead-water pool downstream of the gate.

Still another object of the invention is to provide an automatic canal gate having a discharge lip which directs flowing water into the bottom of a control basin providing accurate control of the depth of the basin water downstream of the gate.

A further object of the invention is to provide a dead-water pool for a pivotal gate having closely adjacent control means which provides optimum control for the depth of the pool downstream the gate and controls the heighth of the water flowing over a discharge weir from the pool.

These and other objects and advantages of the invention may be readily ascertained by referring to the following description and appended illustrations in which.

Figure 1:
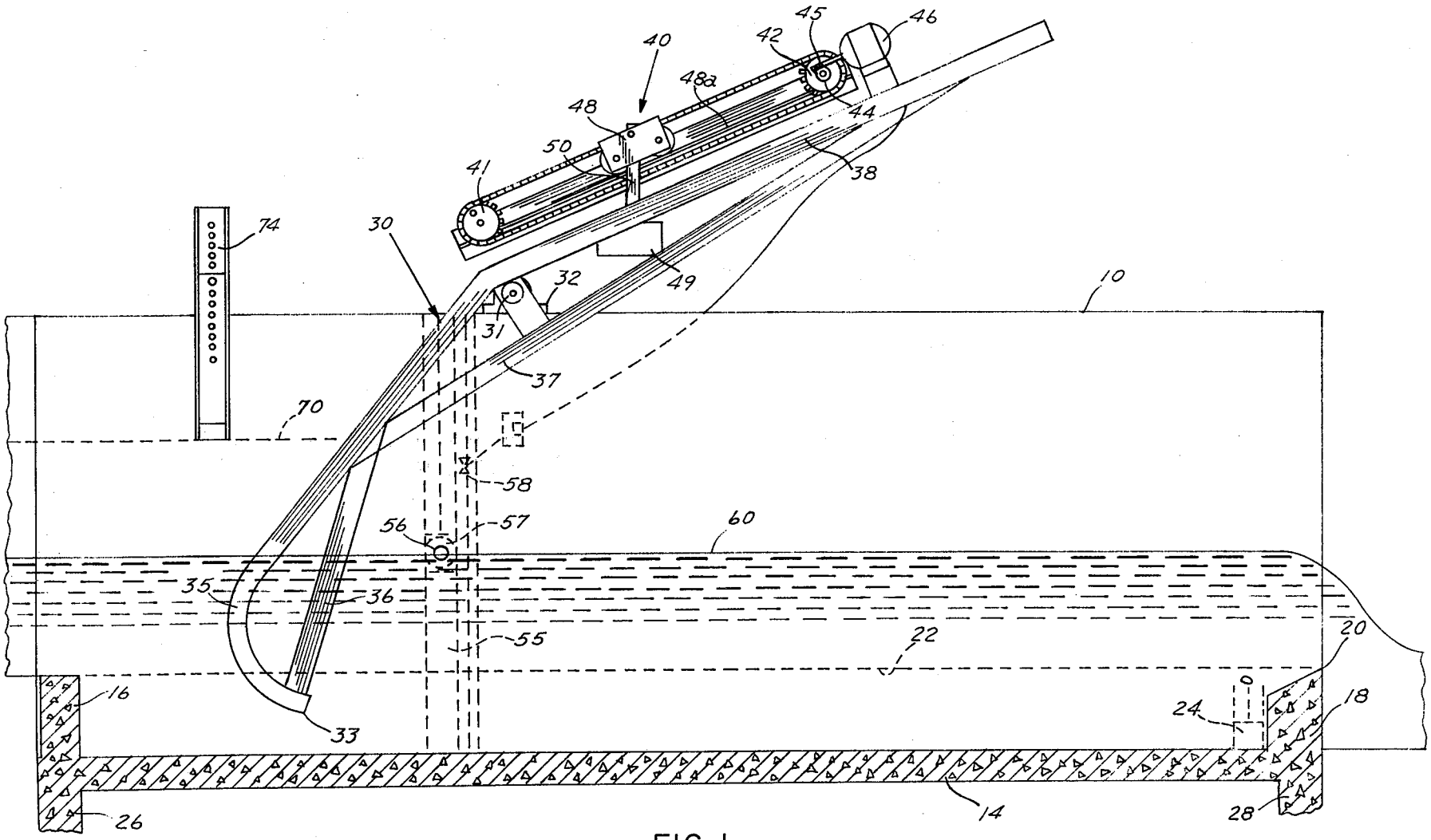
FIG. 1 is a cross-sectional view of an automatic canal gate, according to the invention.

The head-gate shown in FIG. 1 is mounted in a predetermined size canal of a rectangular cross section, which is usually made of concrete to provide accurate dimensions of an entry canal for the distribution canals. The control canal section includes sidewalls 10 and 12 and a bottom 14, stated as before made normally of concrete, however may be metal such as steel or the like where desired. At the head end of the canal is a dam 16, and a dam 18 on the downstream side of the canal provides a weir 20. The dams 16 and 18 provide a basin or dead-water pool of a depth shown by the dash line 22 extending between the tops of the two dams. A clean-out gate 24 should be provided for the removal of trash and sediment from the dead-water pool. The predetermined size canal section is preferably mounted on footings and the like shown at 26 and 28 preventing undermining of the canal section.

A canal gate, shown in general by numeral 30 is pivotally mounted on a pivot shaft 31 mounted in pillow blocks 32 on opposite sides of the canal. The gate is positioned so that it opens and closes into the dead-water pool, with lower lip 33 of the gate arranged to close against the bottom 14 of the dead-water pool. The gate 30 is provided with parabolic section 35 terminating in the lower lip 33. The gate 30 is reinforced by brace members 36 welded or otherwise secured to the downstream side, strengthening the gate to accommodate the pressures involved. An elongated brace member 37 extends from the rear of the gate 30 to a top gate extension framework 38. The framework 38 supports an endless chain tramway, shown in general by numeral 40, which includes sprockets 41 and 42 mounted respectively on axles 41*a* and 42*a* supported for rotation on the framework. Axle 42 is a drive-axle having mounted thereon a worm-wheel 44 rotated by a worm-gear 45. The worm-gear 45 is driven by a reversing electric motor 46, so as to operate equally in either direction. The axles 41 and 42 are mounted in the necessary bearing sets mounted on the framework 38 for proper rotation. Secured to and movable by the chain is a wheeled tramway 48 (moving along a rail 48*a*) having suspended from it a weight 49 by means of a support 50. The motor 46 is arranged to operate the endless chain so as to move the weight forwardly and rearwardly of the framework 38, to balance the gate 30 in response to a float-switch mechanism. A float-switch mechanism is mounted in a housing 55 outside the wall 10, and an orifice 56 provides communication between the housing 55 and the canal 56. A float 57 is mounted in the housing 55 and is arranged to rise and fall according to the depth of the water in the dead-water basin. Water enters through the diverging orifice 56. The orifice 56 may be placed at the lowest water level of the canal operation and since the housing 55 is open, the water therein, entering through the orifice, will assume the depth of the water in the canal downstream of the gate. The float 57 is interconnected with a movable switch mechanism 58 which operates the motor 46 to move the weight 49 toward the gate 30 at low water, and move the weight 49 away from the gate 30 at high water, to thereby balance the gate for its opening to control the flow of water under the gate. The switch mechanism is adjustable to provide desired elevation 60 in the basin below the gate 30. The float-switch mechanism, also, controls the position of the gate as the entering water level changes on the upstream side of the gate. Thus, as the level of incoming water increases, the gate is weighted reducing the opening and thereby reducing the water flow but maintaining the desired depth in the basin. If the incoming water reduces in volume and a lower level, the gate is unweighted, opening it to increase the water flow.

Figure 3:
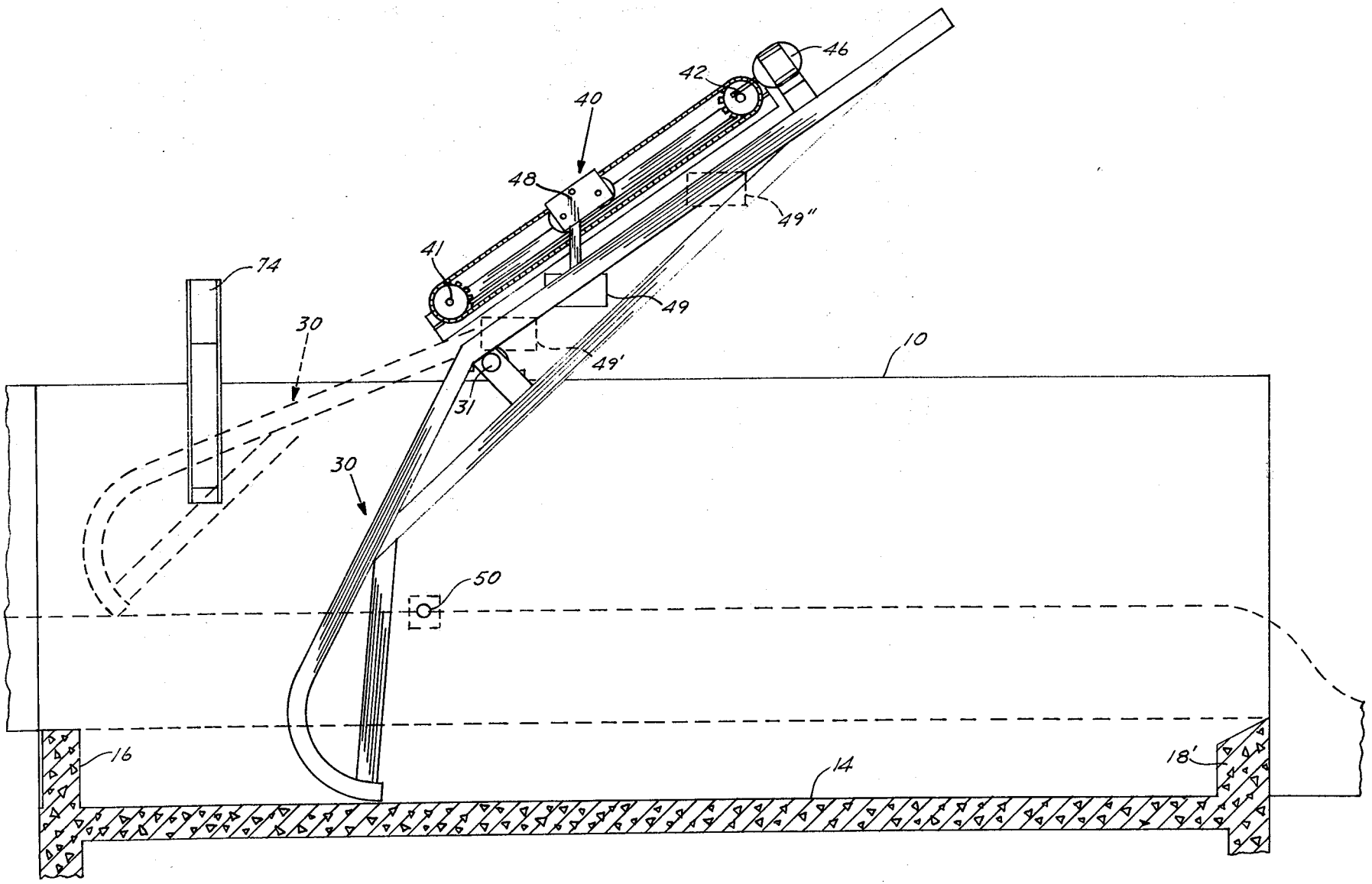
FIG. 3 is a side-elevational cross-section of the device of FIG. 1 schematically showing the operation of the canal gate in reference to the canal.

By maintaining the pool of dead water, with the gate opening and closing into the dead water, the velocity of the water passing under the gate is substantially reduced and a predetermined level of water in the basin below the gate 30 is readily maintained. Therefore, the float mechanism may be placed immediately downstream of the gate (in close proximity) providing very accurate control of the quantity of water to be released over the weir 20. As shown in FIG. 3, the gate 30 is in its closed position when the weight 49 is moved adjacent the pivot shaft 31 of the gate, shown by the dashed lines 49' adjacent to shaft 31. This condition is used to stop water flow in the downstream canal. When the upstream flow is low, the weight 49 may be moved to the outside position 49'' to raise the gate, to the dashed position, where the full flow of the stream goes under the gate into the canal. This condition occurs where the stream flow was less than the desired canal flow. Between these two conditions the weight 49 prepositions the gate in relation to the placement of the switch, controlled by the float 57. As explained above, a weighting container may be secured to the backside of the gate 30 provided with a predetermined orifice and with inlets such as shown in my above-mentioned patent providing a damping action for minor fluctuations of the water, thereby preventing wild fluctuations of the gate with the fluctuation of the water.

Figure 2:
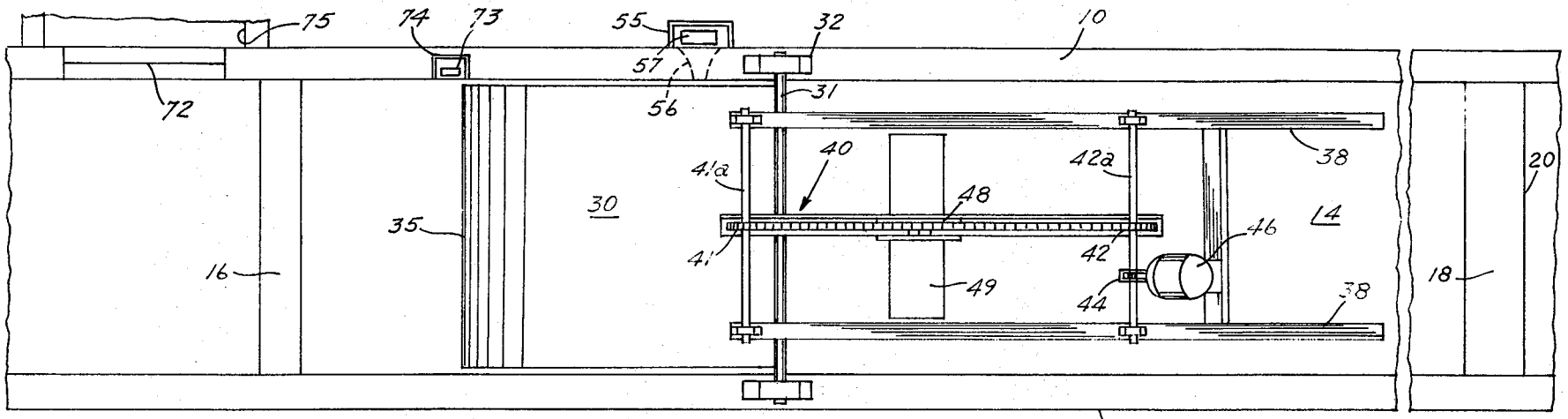
FIG. 2 is a top-plan view of the canal gate of FIG. 1.

As shown in FIG. 1, a flood water level 70 is indicated which is the maximum level that should impinge upon the gate, and to maintain the level 70 as the maximum level, a flood gate arrangement 72, FIG. 2, is provided downstream of the dam 16, controlled by a float mechanism 73 in a housing 74 downstream of the dam 16. The gate 72 may be any conventional flood gate arrangement, including pivoted and shutter type gates, which are actuated by conventional means when the float 73 reaches the elevation designated as the flood level. When the float 73 reaches such an elevation, the flood gates 72 open releasing the excess water to an overflow canal 75. Such flood overflow mechanisms are known in the art and are not part of the present invention. These are described solely to explain the control of the gate within predetermined minimum and maximum levels.

Figure 4:
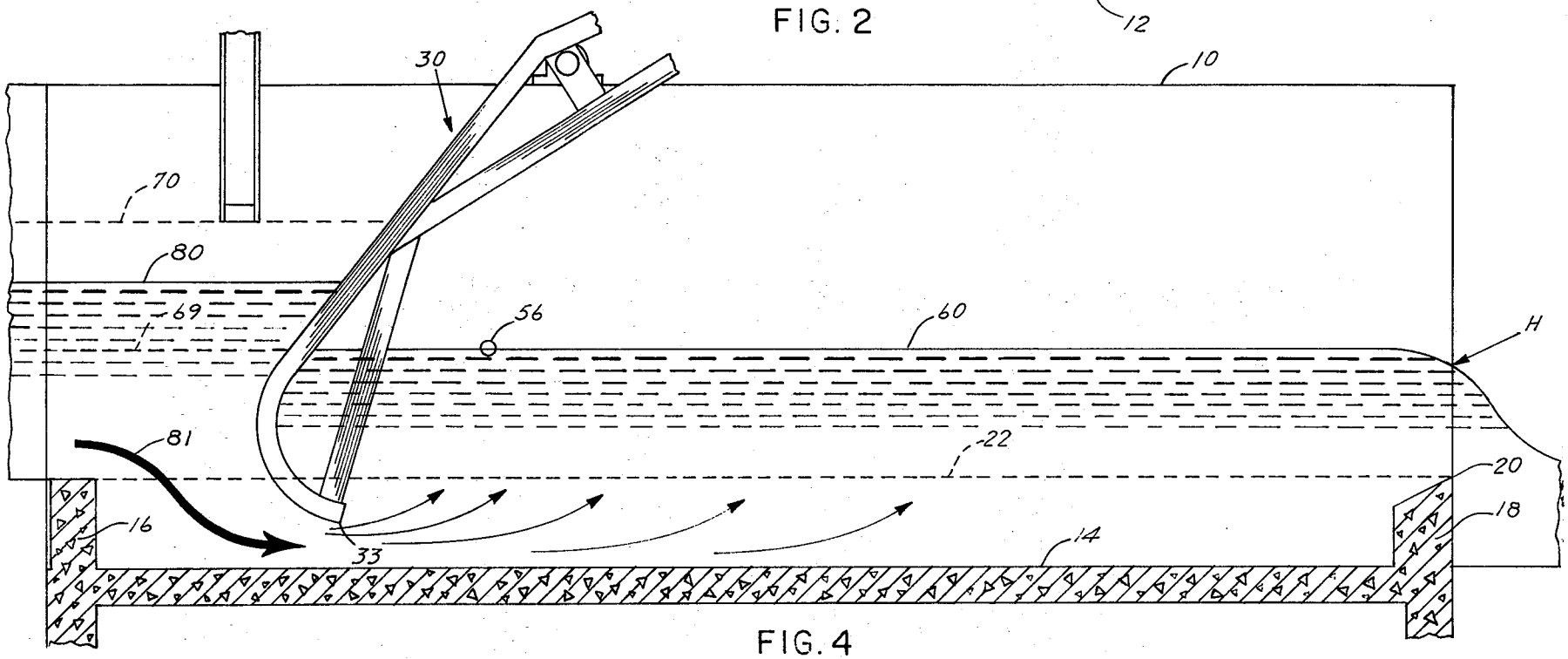
FIG. 4 is a schematic side-elevation showing the flow characteristics of the head water passing under the canal gate of the invention.

As illustrated in FIG. 4, the gate 30 is arranged to control the flow of water under the lip 33 from a minimum flow level 69 to a maximum level 70. For example, at a level 80 from a source, the gate 30 is positioned to provide a level 60 in the basin below the gate with the water flowing through the orifice 56 into the float-switch arrangement. Under these conditions the flow of water 81 under the gate is propelled by the water head between level 60 and level 80 providing a relatively high velocity of water passing under the lip 33 into the pool below the gate. But as illustrated, the flow 80 is broken up by the dead water so that it becomes a relatively slow-moving pool passing over the weir 20 and providing a heighth H as desired. The heighth of the orifice 56 behind the gate 30 is determined by the flow characteristics of the stream and a quantity of water flowing through the canal. At very low flows of the source, all of the water in the head canal will pass under the gate into the distribution canals and the gate may be fully opened. However, at greater flows it is necessary to control the flow of water into the distribution canals and the gate 30 is controlled by means of the weights moving in response to the float-switch arrangement. The dead pool arrangement provides means for moving the float-switch arrangement immediately adjacent the gate 30 to provide better control of the water flowing into the pool, and it also provides for placing the weir closer to the gate reducing the control structure of the canal before the water enters the distribution canals downstream.

I claim:

1. Gate apparatus for automatically regulating water flow into distribution canals and the like, comprising:

a. a rectangular canal section having upright walls, a generally horizontal, flat bottom and having inlet and outlet ends;

b. a low-height dam at the inlet end and a low-height dam at the outlet end providing a dead-water pool therebetween;

c. a gate means pivotally mounted on a shaft supported by said upright walls, and positioned to close against said bottom in said pool;

d. extension means depending from said gate inclusive of a carriage having weights for moving toward and away from the gate balancing the same in relation to inlet water against the gate means;

e. means for moving said carriage;

f. adjustable float-switch means arranged closely adjacent said gate means on the downstream side of said gate means, operable by the depth of water in the downstream side of said gate means, and connected with and operating said means for moving said carriage; and g. said gate means including a rearwardly curved lower portion terminating at a discharge lip for directing incoming water under said gate means and into said dead-water pool for reducing the gross velocity thereof.

2. Gate apparatus according to claim 1 being further characterized by a weir on said downstream dam.

3. Gate apparatus according to claim 1 wherein said extension means depends from said gate means on the opposite side of said shaft.

4. Gate apparatus according to claim 3 wherein said carriage is movable by endless chain means operable by a reversing motor.

5. Gate apparatus according to claim 1 wherein said float-switch means communicates with the downstream side of said gate by a diverging aperture in the wall of said canal section.

6. Gate apparatus according to claim 1 being further characterized by flood release means ahead of said gate means.

* * * * *